United States Patent [19]

Jackman

[11] Patent Number: 4,720,969

[45] Date of Patent: Jan. 26, 1988

[54] REGENERATOR CROSS ARM SEAL ASSEMBLY

[75] Inventor: Anthony V. Jackman, Indianapolis, Ind.

[73] Assignee: The United States of America as represented by the United States Department of Energy, Washington, D.C.

[21] Appl. No.: 311,334

[22] Filed: Oct. 15, 1981

[51] Int. Cl.[4] ..... F02C 1/105; F02G 1/005; F02G 3/005

[52] U.S. Cl. ..... 60/39.512; 165/9

[58] Field of Search ..... 60/39.511, 39.512; 165/9

[56] References Cited

U.S. PATENT DOCUMENTS

| | | | |
|---|---|---|---|
| 3,401,740 | 9/1968 | Trudeau | 165/9 X |
| 3,542,122 | 11/1970 | Bracken, Jr. | 165/9 |
| 3,601,414 | 8/1971 | Rao | 165/9 X |
| 3,913,926 | 10/1975 | Rao | 165/9 X |
| 3,954,135 | 5/1976 | Hewlitt | 60/39.51 H X |
| 4,079,780 | 3/1978 | Tank . | |

FOREIGN PATENT DOCUMENTS

| | | | |
|---|---|---|---|
| 2902923 | 7/1980 | Fed. Rep. of Germany H | 60/39.51 |
| 2064084 | 6/1981 | United Kingdom | 165/9 |

*Primary Examiner*—Carlton R. Croyle
*Assistant Examiner*—Donald E. Stout
*Attorney, Agent, or Firm*—Judson R. Hightower; Richard E. Constant

[57] ABSTRACT

A seal assembly for disposition between a cross arm on a gas turbine engine block and a regenerator disc, the seal assembly including a platform coextensive with the cross arm, a seal and wear layer sealingly and slidingly engaging the regenerator disc, a porous and compliant support layer between the platform and the seal and wear layer porous enough to permit flow of cooling air therethrough and compliant to accommodate relative thermal growth and distortion, a dike between the seal and wear layer and the platform for preventing cross flow through the support layer between engine exhaust and pressurized air passages, and air diversion passages for directing unregenerated pressurized air through the support layer to cool the seal and wear layer and then back into the flow of regenerated pressurized air.

4 Claims, 4 Drawing Figures

REGENERATOR CROSS ARM SEAL ASSEMBLY

The invention described herein was made in the performance of work under a National Aeronautics and Space Administration contract funded by the Department of Energy of the United States Government.

BACKGROUND OF THE INVENTION

This invention relates generally to gas turbine engine regenerator assemblies and, more particularly, to improvements in cross arm sealing between low pressure hot exhaust and high pressure heated air passages at the regenerator disc.

In gas turbine engines, overall efficiency is improved by transferring heat from engine exhaust gas to incoming pressurized air. This is typically effected through a perforated regenerator disc rotatably supported on the engine block and intersecting both the exhaust gas passage and the pressurized air passage. The regenerator disc is heated as it passes through the exhaust gas passage and is cooled as it passes through the air passage, the incoming pressurized air then being heated by the disc prior to further temperature increase in the combustor. The success, in terms of engine performance and efficiency, of such regenerator arrangements depends, at least in part, on the success achieved in minimizing leakage between the exhaust gas passage and the incoming air passage at the inboard side of the regenerator disc where the passages are juxtaposed and convey both pressurized air and exhaust gas at high temperatures. The engine block partition separating the pressurized air and exhaust gas passages at the regenerator disc is typically called a cross arm and numerous cross arm seals have been proposed to maintain gas and air separation at the cross arm. A new and improved cross arm seal assembly according to this invention represents an improvement over heretofore known cross arm seals and is particularly adapted for maintaining both seal integrity in the presence of thermal distortion and effective seal cooling.

SUMMARY OF THE INVENTION

The primary feature, then, of this invention is that it provides a new and improved cross arm seal assembly for a regenerative gas turbine engine. Another feature of this invention is that it provides a new and improved cross arm seal assembly particularly adapted for effective seal cooling and for maintenance of seal integrity in the presence of thermal distortion of the regenerator disc and/or portions of seal assembly. Still another feature of this invention resides in the provision in the new and improved cross arm seal assembly of a platform, a seal and wear layer for sealingly engaging the regenerator disc, and a porous and compliant support layer attached to and disposed between the platform and the seal and wear layer, the support layer being compliant to accommodate relative thermal distortion and porous to conduct cooling air to cool the seal and wear layer. A still further feature of this invention resides in the provision in the new and improved cross arm seal assembly of flow directing means operative to divert relatively cool pressurized air to the platform for transmission through the platform and into the porous and compliant support layer for cooling flow therethrough and escape by way of an unsealed side edge of the support layer exposed to a downstream portion of the pressurized air passage.

These and other features of this invention will be readily apparent from the following specification and from the drawings wherein.

Figure 1:
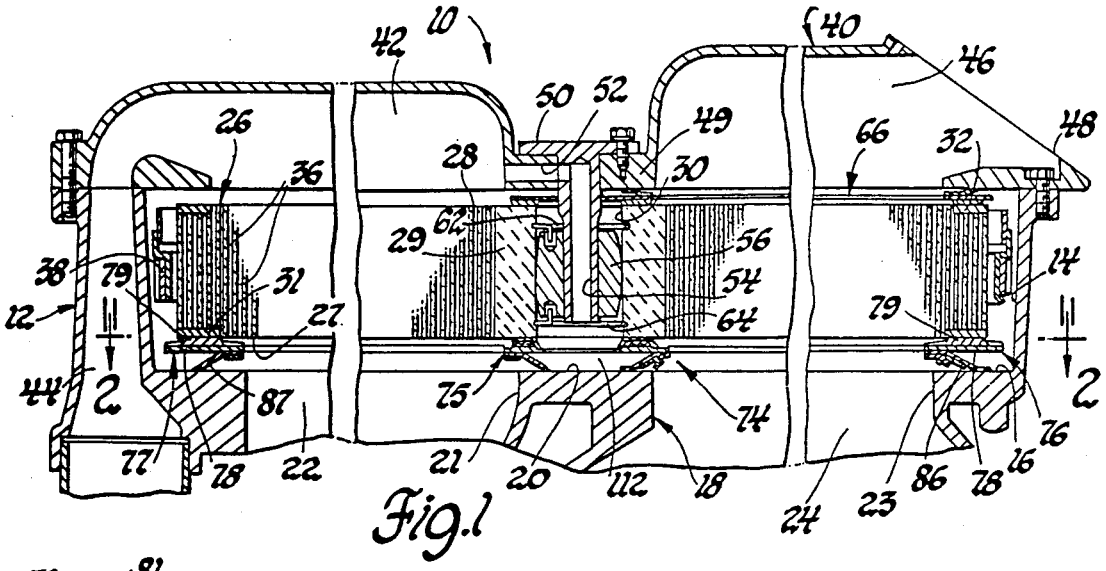
FIG. 1 is a sectional view of a portion of a regenerative gas turbine engine having a cross arm seal assembly according to this invention.

Referring now to FIG. 1 of the drawings, there shown is a portion of a regenerative gas turbine engine designated generally 10 including an engine block 12 defining a cylindrical regenerator disc cavity 14 having an annular base surface 16 extending completely around the circumference of the cavity 14. A partition 18 formed by the engine block 12, hereinafter referred to as the cross arm 18, extends generally diametrically across the cylindrical cavity 14 and includes a top surface 20 disposed in the plane of annular base surface 16. The cross arm 18 cooperates with a generally D-shaped cavity 21 in the engine block in defining an inner air passage 22 extending from the cavity 14 to the combustor of the engine, not shown. Similarly, the cross arm 18 cooperates with another generally D-shaped cavity 23 in the engine block in defining an inner exhaust gas passage 24 extending from the turbine of the engine, not shown, to the cavity 14.

Figure 2:
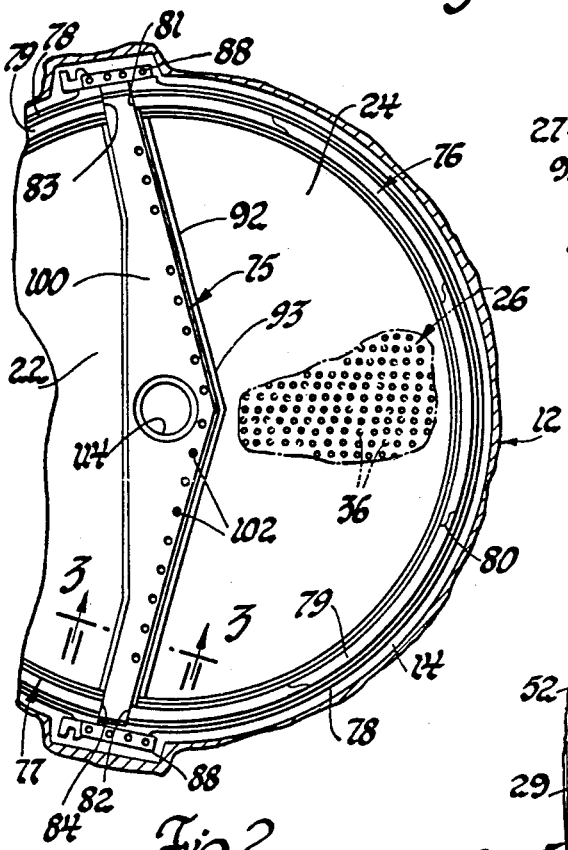
FIG. 2 is a partially broken away sectional view taken generally along the plane indicated by lines 2—2 in FIG. 1.
Figure 3:
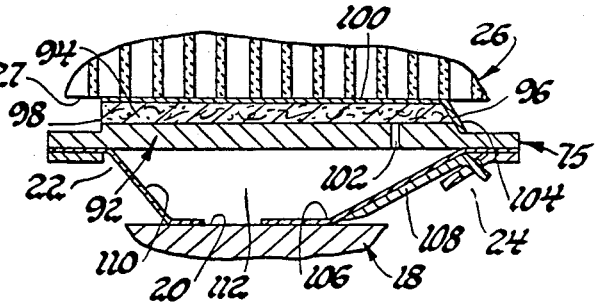
FIG. 3 is an enlarged sectional view taken generally along the plane indicated by lines 3—3 in FIG. 2.

As best seen in FIGS. 1, 2 and 3, a circular regenerator disc 26 is disposed in cavity 14 and includes an inboard surface 27 facing surfaces 16 and 20 on the block 12 and on outboard surface 28. In addition, the disc 26 includes an integral cylindrical hub 29 having a bore 30 therethrough, an inboard solid ring 31 and an outboard solid ring 32. The disc 26 is preferably fabricated from ceramic material such as alumina silicate and has a plurality of cells 36 extending between the inboard and outboard surfaces 27 and 28. A ring gear 38 is attached at the outside diameter of the disc 26 and functions in known manner to rotate the disc.

A generally circular cover 40 is bolted to the engine block 12 over the cavity 14 and includes an outer air passage 42 extending between the regenerator disc cavity 14 and a compressor discharge passage 44 in the engine block. The outer air passage 42 directs relatively cool, on the order of 400°-500° F., pressurized air discharged by the engine's compressor, not shown, to the regenerator disc cavity. The cover 40 also includes an outer exhaust gas passage 46 extending between the regenerator disc cavity 14 and an outlet 48 adapted for connection to conventional exhaust gas ducting. Mounted centrally of the cover 40 on a generally diametrically extending soid portion 49 between outer air passage 42 and outer exhaust gas passage 46 is a spindle 50 bolted to the cover and projecting into the disc cavity 14. A diversion passage 52 in the cover 40 extends between the outer air passage 42 and a bore 54 in the spindle, the bore 54 being open at the end of the spindle opposite cover 40.

Figure 4:
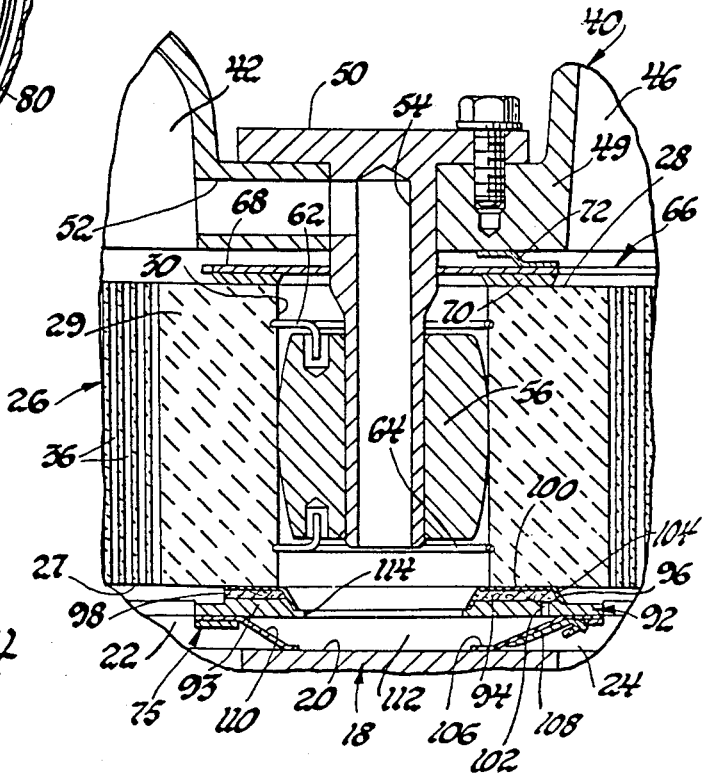
FIG. 4 is an enlarged view of a portion of FIG. 1 showing the regenerator disc center support.

As best seen in FIGS. 1 and 4, a hub bearing 56 is rotatably received on the spindle 50 and is, in turn, received within the bore 30 in hub 29 on the regenerator disc 26. A pair of retaining rings 62 and 64 connect the bearing 56 to the hub 29 for unitary rotation about the spindle and maintain the hub bearing within the bore 30.

The spindle 50 thus supports and centers the disc 26 within the cavity 14 such that the disc intersects the continuous air intake passage formed by inner and outer air passages 22 and 42 and the continuous exhaust gas passage formed by inner and outer exhaust passages 24 and 46.

A conventional outboard seal assembly 66 is disposed between the outboard surface 28 of the regenerator disc and the cover 40 around the outer exhaust gas passage 46. The outboard seal assembly includes a D-shaped metal platform 68 carrying a wear surface 70 which engages the outboard surface 28 of the disc at the ring 32 and generally diametrically across the disc. Opposite the wear surface, a leaf seal assembly 72 is affixed to the platform 68 and engages a facing surface on the cover 40 across solid portion 49 and around the outer exhaust gas passage 46. A seal is thus formed between the outboard surface 28 of the regenerator disc and the cover 40 around the outer exhaust gas passage preventing escape of exhaust gas or intrusion of cold pressurized air. A representative outboard seal assembly is shown and described in U.S. Pat. No. 3,542,122, issued Nov. 24, 1970 to Joseph W. Bracken, Jr. and assigned to the assignee of this invention, but any functionally equivalent seal can be used.

At the inboard surface 27 of the regenerator disc an inboard seal arrangement 74 including a cross arm seal assembly according to this invention and designated generally 75 maintains separation between the inner air passage 22 and the inner exhaust gas passage 24. The inboard seal arrangement 74 includes an exhaust side seal 76 extending around the inner exhaust gas passage 24 from one end of the cross arm 18 to the other. Similarly, the inboard seal arrangement 74 includes an air side seal 77 extending around inner air passage 22 from one end of the cross arm 20 to the other. The seals 76 and 77 are identical, conventional in construction, and include a plurality of arc-shaped seal and wear face sections 79 carried on a metal platform 78. The seal and wear face sections abut at lap joints, as at 80 in FIG. 2, to provide a continuous arc-shaped seal and wear surface extending from a first edge 81 to a second edge 82 on gas side seal 76 and from a first edge 83 to a second edge 84 on air side seal 77. An arc-shaped gas side leaf seal 86 is attached to the platform 78 and engages the base surface 16 of the engine block to seal the space between the block and the regenerator disc inboard surface around the periphery of the inner exhaust passage generally from first edge 81 to second edge 82. Similarly, an arc-shaped air side leaf seal 87 is attached to the platform 78 and engages the base surface 16 of the engine block to seal the space between the block and the regenerator disc inboard surface around the periphery of the inner air passage 22 generally from first edge 83 around to second edge 84. Representative gas side and air side leaf seals 76 and 77 are shown and described in the aforementioned Bracken, Jr. patent but, again, any functionally equivalent seals can be used. A pair of diametrically opposed tabs 88 are attached to the seals 76 and 77 and engage abutments, not shown, on the engine block to prevent rotation of the rim seals during rotation of the regenerator disc.

As seen best in FIGS. 1, 2 and 3, the cross arm seal assembly 75 according to this invention includes a metal platform 92 located above and coextensive with the top surface 20 on the cross arm 18 generally in the plane defined by the platform 78 of the seals 76 and 77. The platform 92 is relatively narrow at its distal ends, which are captured between the ends of the arc-shaped halves of platform 78 to form a generally continuous thetaring metal platform, and includes an enlarged center section 93 generally underlying the hub 29 of the regenerator disc 26. A porous and compliant support layer 94 having a first edge 96 facing the inner exhaust gas passage 24, a second edge 98 facing the inner air passage 22, and opposite edges at the distal ends of platform 92 is disposed on the upper surface of the platform 92. The porous and compliant layer 94 is most preferably a nickle-chrome metallic alloy, three-dimensional, reticulated, open-cell substrate on the order of 0.1 inches in thickness manufactured in accordance with the disclosure of U.S. Pat. No. 3,694,325, issued Sept. 26, 1972 to Seymour Katz et al and assigned to the assignee of this invention. In the high temperature environment of a gas turbine cross arm seal the metallic alloy of the substrate is preferably of a composition approximating 20% chrome and 80% nickle and the substrate is affixed to the platform by high-temperature resistant means such as nickle brazing.

With particular reference to FIG. 3, a seal and wear layer 100 is disposed on the support layer 94 and slidably and sealingly engages the inboard surface 27 of the regenerator disc 26 across the full diameter of the latter from one distal end of the platform 92 to the other. At the distal ends of the platform 92, the seal and wear layer 100 forms a generally continuous surface with the wear surfaces 79 on the platform 78 adjacent first edges 81 and 83 and second edges 82 and 84. The seal and wear layer, in the preferred embodiment, is deposited on the support layer in a three step plasma spray application after the upper surface of the support layer has been prepared by localized crushing of the substrate at the surface to improve density and grinding to improve surface finish. The plasma spray application includes a first step whereby a bond coat available from Alloy Metals Incorporated, Troy, Mich., 48084, and composed of an alloy of nickle, chromium, aluminum and yttrium, is deposited to a depth of between 0.002 and 0.003 inches. In a second step, a barrier coat of nickle oxide to a thickness of between 0.008 and 0.010 inches is deposited on the bond coat. In a third step, a wear coat of nickle oxide and calcium fluoride in proportions of about 90% nickle oxide and 10% calcium fluoride is deposited on the barrier coat to a thickness of between 0.030 and 0.040 inches. The seal and wear layer 100 forms an effective barrier between the cells 36 of the regenerator disc and the porous and compliant layer 94 to substantially prevent gas passage therebetween.

With continued reference to FIG. 3, a plurality of cooling air flow ports 102 extend through the platform 92 generally adjacent the edge of the platform exposed to inner exhaust gas passage 24. A dike 104 extends from the upper surface of the platform 92 to the seal and wear layer 100 at the first edge 96 of the support layer. The dike is an effective barrier to gas or air flow and therefore cooperates with the seal and wear layer 100 and the upper surface of the platform 92 in defining a three-sided enclosure for the support layer 94, the enclosure being open only at the second edge 98 exposed to inner air passage 22, at the flow ports 102, and at the distal ends of the platform 92 exposed to the volume in cavity 14 outside of seals 76 and 77. In the preferred embodiment the dike 104 is an integral extension of the seal and wear layer 100 formed by simply extending the plasma spray application along the first edge 96. It will, however, be understood that other convenient methods of forming such a dike are available, as for example localized crushing of the support layer anywhere between flow ports 102 and inner exhaust gas passage 24.

A primary leaf spring seal 106, FIG. 3, is rigidly attached to the lower surface of the platform 92 along the edge of the latter adjacent inner exhaust gas passage 24 and engages top surface 20 on the cross arm 18. The seal 106 is reinforced and rigidified by a backing structure 108 also rigidly attached to the lower surface of the platform. A leaf spring assembly as shown and described in the aforementioned Bracken, Jr. patent is representative of functionally equivalent types of leaf spring seals which can be used. A leaf spring baffle 110 is attached to platform 92 along the opposite edge of the platform adjacent inner air passage 22, and engages top surface 20 of the cross arm so that the baffle 110 cooperates with the leaf spring seal 106, the platform 92 and the top surface 20 in defining a tunnel 112 coextensive with the cross arm 18 and open at opposite ends to the volume of cavity 14 outside of seals 76 and 77. A circular aperture 114 in the platform 92 is disposed immediately below the bore 54 in the spindle 50 so that the tunnel 112 is also in communication with the outer air passage 42 through diversion passage 52 and bore 54. The support layer 94 and the seal and wear layer 100 surround the aperture 114 in the platform so that a continuous seal interface is maintained between the seal and wear layer and the disc across the entire diameter of the regenerator disc while the seal and wear layer closes the edge of the opening in the support layer above aperture 114 to prevent airflow directly into the support layer from bore 54.

Describing now the operation of the cross arm seal assembly 75 according to this invention, when the engine is operating a supply of pressurized, relatively cool, compressor discharge air is delivered through passage 44 and outer air passage 42 to the outboard surface 28 of the regenerator disc. Simultaneously, hot exhaust gas is delivered through inner exhaust passage 24 to the inboard surface 27 of the regenerator disc. The hot gas passes through the cells 36 of that portion of the disc intersecting the exhaust gas passage thereby heating the regenerator disc prior to exiting at the outboard surface 28 into the outer exhaust passage 46. As the disc is rotated the heated cells are brought into alignment with outer air passage 42 and compressor discharge air is forced down through the hot cells and heated prior to exiting at the inboard surface 27 into the inner air passage 22. In addition to flowing through the regenerator disc, the compressor discharge air fills the regenerator cavity volume outside of the seals 76 and 77 and biases the seal leafs 86 and 87 against surface 16 on the engine to maintain a tight seal. The compressor discharge air also exerts an upward bias on the platform sections 78 of the seals to urge the wear surfaces on the latter against ring 31 on the regenerator disc to maintain a sealed interface.

With particular reference to FIGS. 1, 3 and 4 and describing airflow at the cross arm seal assembly, relatively cool compressor discharge air is diverted from outer air passage 42 through the diversion passage 52, bore 54 in the spindle, and aperture 114 in the platform into the tunnel 112. Air thus diverted to the tunnel 112 combines with compressor discharge air entering the tunnel at the distal ends of the platform 92 to maintain the tunnel in a pressurized condition so that the leaf seal 106 and baffle 110 are tightly pressed against the top surface 20 of the cross arm while the platform 92 is biased upward to maintain the seal and wear layer 100 tightly against the regenerator disc inboard surface. Separation between inner exhaust gas passage 24 and inner air passage 22 across cross arm 18 is thereby maintained.

The regenerator disc 26 restricts the flow of pressurized relatively cool compressor discharge air by an amount sufficient to maintain the pressure in the tunnel 112 slightly in excess of the pressure in inner air passage 22. Accordingly, air in the tunnel 112 is forced through the flow ports 102 into the porous and compliant layer 94. Since the dike 104 prevents communication between the support layer and inner exhaust gas passage 24, the relatively cool compressor discharge air traverses generally the entire width of the platform 92 and seal and wear layer 100 before exiting into inner air passage 22 through the second edge 98. During such passage the compressor discharge air effectively cools the seal and wear layer 100. In addition, some compressor discharge air may enter the support layer 94 at the distal ends of the platform from the volume outside the seals 76 and 77 to also flow through the support layer and out through second edge 98 thereby assisting in the cooling function. If desired, however, these distal ends can be closed by dikes as described with respect to dike 104.

In addition to permitting cooling airflow adjacent the platform 92 and the seal and wear layer 100, the support layer 94 inherently exhibits a limited degree of compliancy perpendicular to the platform which serves to maintain sealing engagement between the inboard surface of the disc and the seal and wear layer in the presence of thermal distortion. For example, when the temperature gradients experienced by the disc and the platform 92 cause each to warp or distort out of flatness the substrate flexes due to flexure of each of the individual strands or mesh elements making up the substrate. Accordingly, to a limited degree, the substrate will deform to absorb the dimensional changes created by the distortion so that the integrity of the seal created by seal and wear layer 100 on the disc is maintained. Further, the support layer 94 also exhibits a limited degree of compliancy parallel to the platform 92 which functions to accommodate relative thermal growth between the seal and wear layer 100 and the platform 92 occurring because of unequal coefficients of thermal expansion for the platform and the seal and wear layer.

The embodiments of the invention in which an exclusive property or privilege is claimed are defined as follows:

1. In a gas turbine engine having block means defining a pressurized air passage and a hot exhaust gas passage and a cross arm partition separating portions of said air and said exhaust passages, a regenerator disc on said block means intersecting said air and said exhaust passages and rotatable to transfer heat from said exhaust gas to said pressurized air and including an inboard surface, and rim seal means between said disc inboard surface and said block means operative to prevent pressurized air and exhaust gas leakage around the periphery of said disc, an improved cross arm seal assembly comprising, a platform generally coextensive with said cross arm partition disposed between the latter and said disc inboard surface, a porous and compliant support layer on a surface of said platform facing said disc inboard surface, a seal and wear layer on said support layer defining a barrier to gas passage and sealingly engaging said disc inboard surface, dike means between said seal and wear layer and said platform preventing communication through said support layer between said air and said exhaust passages, seal means between said platform and said cross arm partition preventing communication between said air and said exhaust passages across said cross arm partition, and means on said block means and on said platform operative to direct air from said pressurized air passage to and through said support layer thereby to cool said seal and wear layer.

2. In a gas turbine engine having block means defining a pressurized air passage and a hot exhaust gas passage and a cross arm partition separating portions of said air and said exhaust passages, a regenerator disc on said block means intersecting said air and said exhaust passages and rotatable to transfer heat from said exhaust gas to said pressurized air and including an inboard surface, and rim seal means between said disc inboard surface and said block means operative to prevent pressurized air and exhaust gas leakage around the periphery of said disc, an improved cross arm seal assembly comprising, a platform generally coextensive with said cross arm partition disposed between the latter and said disc inboard surface and having a first surface facing said disc inboard surface and a second surface facing said cross arm partition, a porous and compliant support layer on said platform first surface having a first edge exposed to said exhaust gas passage and a second edge exposed to said pressurized air passage, a seal and wear layer on said support layer between said first and said second edges of the latter defining a barrier to gas passage and sealingly engaging said disc inboard surface, dike means at said first edge of said support layer between said seal and wear layer and said platform first surface preventing communication through said support layer between said exhaust and said air passages, seal means between said platform second surface and said cross arm partition preventing communication between said pressurized air and said exhaust passages across said cross arm partition, and means on said block means and on said platform operative to direct air from said pressurized air passage upstream of said regenerator disc to and through said support layer and back into said pressurized air passage downstream of said regenerator disc thereby to cool said seal and wear layer.

3. The improvement recited in claim 2 wherein said porous and compliant support layer is a metallic, three-dimensional, reticulated, open-celled substrate having a metal composition of about 20% chromium and 80% nickle.

4. In a gas turbine engine having block means defining a pressurized air passage and a hot exhaust gas passage and a cross arm partition separating portions of said air and said exhaust passages, a regenerator disc on said block means intersecting said air and said exhaust passages and rotatable to transfer heat from said exhaust gas to said pressurized air and including an inboard surface, and rim seal means between said disc inboard surface and said block means operative to prevent pressurized air and exhaust gas leakage around the periphery of said disc, an improved cross arm seal assembly comprising, a platform generally coextensive with said cross arm partition disposed between the latter and said disc inboard surface and having a first surface facing said disc inboard surface and a second surface facing said cross arm partition, a porous and compliant support layer on said platform first surface having a first edge exposed to said exhaust gas passage and a second edge exposed to said pressurized air passage, a seal and wear layer on said support layer between said first and said second edges of the latter defining a barrier to gas passage and sealingly engaging said disc inboard surface and overlapping said support layer first edge thereby to form a dike between said seal and wear layer and said platform preventing communication through said support layer between said exhaust passage and said pressurized air passage, seal means between said platform second surface and said cross arm partition preventing communication between said air and said exhaust passages across said cross arm partition, means on said platform defining a plurality of coolant flow ports between said platform first and said platform second surfaces operative to conduct air across said platform and into said support layer, said air escaping from said support layer into said pressurized air passage downstream of said regenerator disc through said support layer second edge, and means on said block means operative to direct pressurized air from said pressurized air passage upstream of said regenerator disc to said coolant flow ports thereby to flow pressurized air through said support layer for cooling said seal and wear layer.

* * * * *